United States Patent [19]

Strömbäck

[11] 4,049,132

[45] Sept. 20, 1977

[54] CRANE ADAPTED TO THE HANDLING OF UNIFORM CARGO UNITS

[75] Inventor: Per Strömbäck, Lindome, Sweden

[73] Assignee: Salen & Wicander Terminalsystem AB, Goteborg, Sweden

[21] Appl. No.: 721,713

[22] Filed: Sept. 9, 1976

[30] Foreign Application Priority Data

Sept. 12, 1975 Sweden ..... 7510168

[51] Int. Cl.[2] ..... B66C 19/00

[52] U.S. Cl. ..... 214/14; 214/59 R; 214/658; 212/14; 212/18

[58] Field of Search ..... 214/12, 14, 38 R, 59 R, 214/95 R, 628, 658, 650; 212/10, 11, 13, 14, 18

[56] References Cited

U.S. PATENT DOCUMENTS

| | | | |
|---|---|---|---|
| 1,057,735 | 4/1913 | Hertz | 214/14 X |
| 3,675,786 | 7/1972 | Wilson | 212/11 X |

*Primary Examiner*—Robert J. Spar
*Assistant Examiner*—George F. Abraham
*Attorney, Agent, or Firm*—Cantor and Singer

[57] ABSTRACT

Means for transporting shipping containers from a quay to a ship includes a crane having a lifting yoke and an operator's cage at an elevated level, as well as a guiding device located at a lower level than said cage and being adapted to be positioned above a selected container for directing the yoke into engagement therewith.

5 Claims, 2 Drawing Figures

CRANE ADAPTED TO THE HANDLING OF UNIFORM CARGO UNITS

BACKGROUND OF THE INVENTION

When loading and unloading cargo units of uniform size, in the first hand standard shipping containers, in connection with ships, an overhead crane is often used. This crane is provided with a gantry runway, which extends over a ranging area at the quay being continued by a cantilever portion reaching out from the edge of the quay. Alternatively a crane having a long, swinging arm may be used. These cranes are movable on rails along the quay. The containers are usually stored in several superimposed layers, and in order to be able to place containers properly as deck cargo the crane operator's cage must be located at a considerable height above the level of the quay.

This implies definite difficulties for the operator to select containers in the proper sequence and to attach the lifting means in a safe manner.

A standard shipping container is at its upper corners provided with strong boxes, having openings for gripping means, and the lifting means of the crane includes a yoke provided with operable gripping means for engagement with said openings.

The work of the operator should be considerably reduced, and the cargo handling should be much faster, as compared to the conventional procedure, if the operator had to care for the lifting only, while the selection of the container and the guiding of the yoke towards the same was performed by other personell.

SUMMARY OF THE INVENTION

A safer and more expedient handling is obtained by using a crane having lifting means including a yoke, and a separately operable guiding device located at a lower level than the operator's cage at the crane, said guiding device being adapted to be positioned above a selected cargo unit for directing the yoke into engagement therewith. The quay conventionally is provided with rails so the crane and the guiding device, respectively, may be moved along the quay's edge.

The separate crane is preferably an overhead gantry crane, and a runway for the guiding device is then located in parallel to, and directly below the gantry runway of the crane.

DESCRIPTION OF A PREFERRED EMBODIMENT

Figure 1:
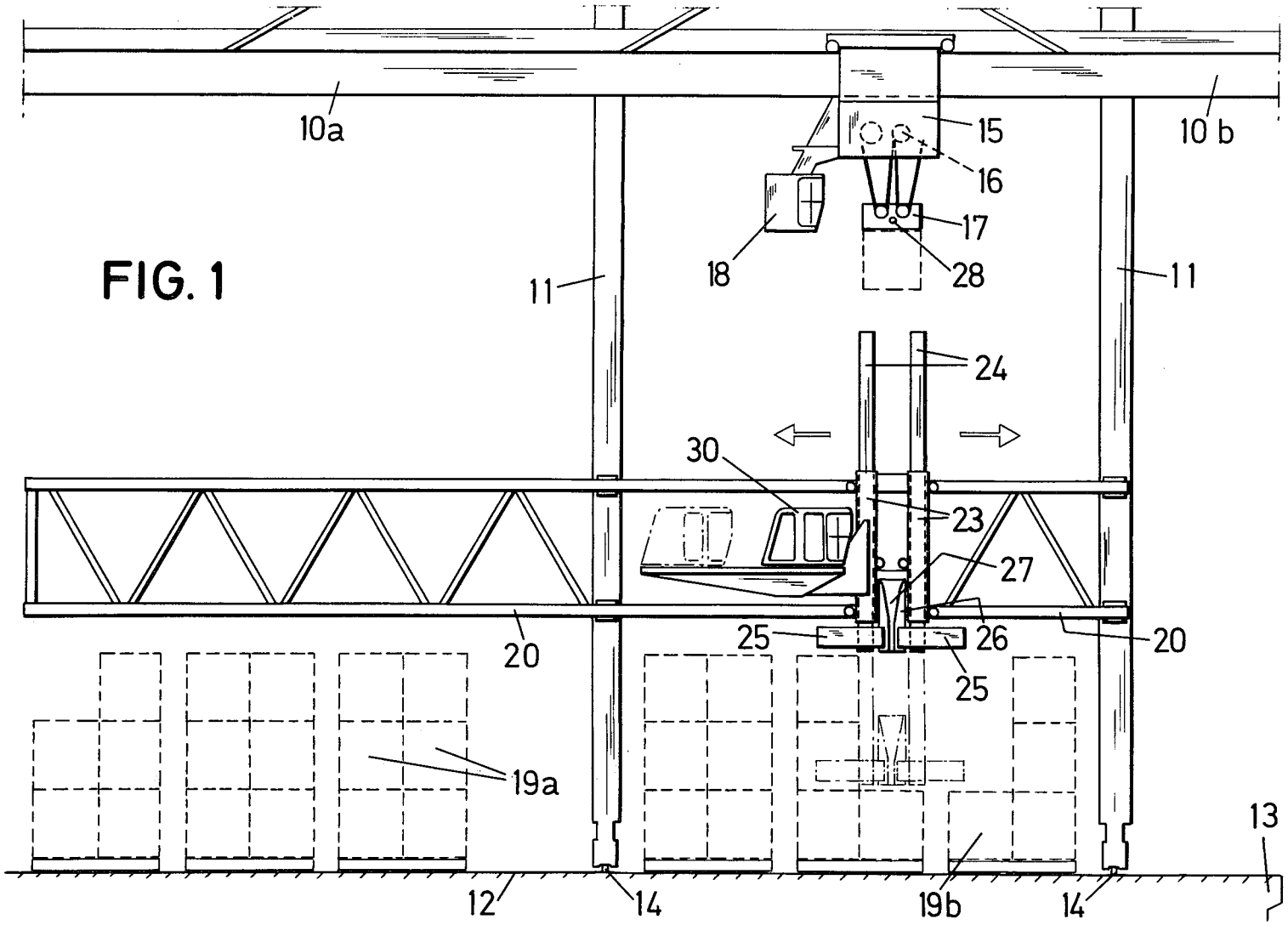
FIG. 1 is a part elevation of a crane according to the invention.

A crane of the type shown in the drawings includes a portal structure carrying a horizontal gantry runway 10*a*, 10 *b*. The portal structure comprises four vertical pillars 11, which are interconnected in conventional manner, not shown in the drawing.

A ship's loading quay is denoted by 12, and the edge of this quay is indicated at 13. Rails 14 run parallel to the edge of the quay and permit the crane to be moved parallel to the quay's edge.

The gantry runway extends with a considerable portion 10*a* over a ranging area at the quay, and presents a cantilever portion outside the edge thereof, so a container may be placed at a desired position on board a ship moored along the quay. The gantry runway is not shown in its full extent, and the cantilever portion 10*b* is preferably pivotable about a horizontal axis located close by the portal structure, so the cantilever portion 10*b* may be swung to a vertical position while the ship is brought along the quay.

The gantry runway is in conventional manner provided with a trolley 15, which is movable in the longitudinal direction of the runway, and includes lifting means comprising a winching machinery 16 and a yoke 17. In order to permit adaptation of the yoke to different lengths of standarized cargo units the yoke is adjustable and is often termed a "spreader yoke". Lifting and lowering of the yoke, as well as the movement of the trolley along the runway is directed by an operator housed in a cage 18 located immediately below the trolley.

It is evident that an operator located in this cage will have certain difficulties in following the activities at the quay, and to direct the yoke towards a certain container. This guiding is made further difficult by the containers sometimes having different length.

The drawings show how a large number of containers 19*a*, 19*b* are arranged at the quay waiting to be loaded upon a ship. The containers are stowed in piles, two side by side, and three on top of each other. The breadth of the gantry runway is selected so as to permit handling of the longest containers 19*a* presently available (40 feet), but FIG. 2 also shows a number of "half-containers" 19*b* (20 feet). There are further containers having a length in-between these measures. The various types of containers have the same breadth, but their height may vary, however not to the same extent as their lengths.

In order to facilitate the handling the crane is provided with second gantry means 20 located at a height slightly exceeding that of a pile of containers, which preferably does not include more than three superposed units. This gantry means extends directly below the primary gantry runway 10*a*, 10*b*, along the shoreward end thereof, and carries a second trolley, consisting of two bogies 21 and a beam structure 22 interconnecting the bogies. Each bogie carries two vertical, tubular pillars 23. A rod 24 is displaceably fitted in each of these pillars. The vertical position of these rods with respect to the pillars may be adjusted in arbitrary, known manner, not shown here, so the guides may be brought to correspond with containers located at different levels within the piles.

The lower ends of the two rods at each bogie are interconnected and carry a link system including a pair of articulated arms 25, which are movable in a horizontal plane. The outward ends of the arms in each pair are interconnected by means of a guide member 26 having a vertical groove 27 increasing in breadth in the direction upwards. The two oppositely located grooves are adapted to catch studs 28 at the ends of yoke 17, and to govern the latter towards proper position in relation to a selected container.

The guide members 26 are provided with remotely controlled means 29 adapted to grip the corners of container and thereby to hold the guide member in proper position in exact position.

Figure 2:
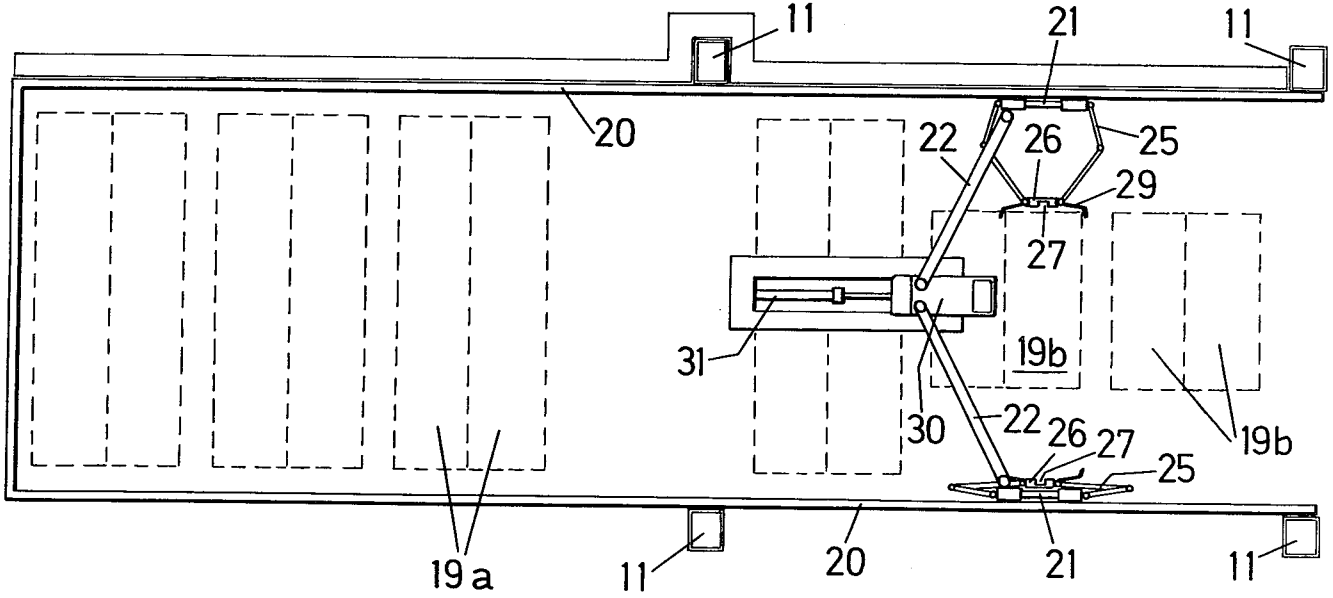
FIG. 2 shows a horizontal section just above the lower traverse runway.

FIG. 2 illustrates, in its upper part, how the guide member 26, by means of the link system 25 has been moved to a small container 19*b*, while the lower part shows how the link system can retract the guide member to a position close by the bogie 21 for the handling of large containers 19*a*.

The second trolley 21, 22 is operated from an operator's seat located in a cabin 30. The operator here has a plan showing how the containers are stored on the quay, as well as a loading plan for the ship. His task is to select the proper container according to the loading plan, and to direct the guides 26 to this container. The operator at the upper crane will then only have to move the yoke to an approximate position above the guide, and then to lower the yoke, which will be automatically brought to correct position. Having engaged the yoke with the container the first operator will move the same from the quay to the ship.

The operator in cabin 30 checks the cargo as it is lifted on board and will thus simultaneously serve as tally-man. In order to facilitate the supervision cabin 30 is movable in relation to the trolley in the longitudinal direction of its runway. This movement preferably is brought about by means of a hydraulic ram 31. During adjustment of the guides 26 cabin 30 is brought to its most forward position, while the cabin, during the actual lifting, for safety's sake, is retracted.

As above described the invention is especially suited for the handling of containers, but may also be used with other types of cargo units of uniform size, such as semi-containers and so called flats.

If the crane is of the type having a long swinging arm, the gantry means for the guides will be mounted at a separate portal structure, which is movable along the rails independently of the portal structure carrying the crane.

What I claim is:

1. Means for handling cargo units of uniform size at a quay having a ranging area and adapted for mooring a ship along its water edge, and comprising a crane extendable over said ranging area and reaching outside the quay's water edge and having lifting means being terminated by a yoke for piecemeal engaging said cargo units, guiding means at two opposite edges of said yoke, an operator's cage at an elevated level at said crane, a gantry means extendable over said ranging area and located at a lower level than said operator's cage, a trolley movable along said gantry means and an operator's seat at said trolley, and two guides at said trolley located oppositely to each other and each having a guide member for cooperating with the guide means at said yoke.

2. The cargo handling means according to claim 1, in which the guides at the trolley are provided with means for positioning their guiding members in the vertical direction.

3. The cargo handling means according to claim 1, in which the yoke is of the spreader type and the trolley is provided with articulated arms for mounting the guides, said trolley further having means for operating said arms for adjusting the horizontal distance between said oppositely located guide members.

4. The cargo handling means according to claim 1, in which the operator's seat at the trolley of the gantry means is located in a cabin structure, which is movable forwards and backwards with respect to the trolley, in the longitudinal direction of the gantry means.

5. The cargo handling means according to claim 1, in which the crane is an overhead gantry crane and includes a horizontal runway arranged perpendicularly to the quay's edge and the lifting means includes a trolley for movement along said runway, the gantry means, carrying the guides, being located in parallel to, and directly below the ranging area part of the runway of the overhead crane.

* * * * *